US005952929A

United States Patent [19]

Yasushi et al.

[11] Patent Number: 5,952,929

[45] Date of Patent: Sep. 14, 1999

[54] WAKE-UP DEVICE

[75] Inventors: Mitsuo Yasushi; Hiroshi Satoh; Hidekazu Yoshida, all of Tokyo, Japan

[73] Assignee: Pioneer Electronic Corporation, Tokyo, Japan

[21] Appl. No.: 09/071,917

[22] Filed: May 5, 1998

[30] Foreign Application Priority Data

May 12, 1997 [JP] Japan ..... 9-120923

[51] Int. Cl.[6] ..... G08B 23/00

[52] U.S. Cl. ..... 340/575; 180/272; 340/576; 340/691.5; 340/692

[58] Field of Search ..... 340/575, 576, 340/439, 309.15, 692, 691.5, 691.2, 328; 180/272

[56] References Cited

U.S. PATENT DOCUMENTS 3,610,943 10/1971 Jones ..... 307/10.4
3,794,968 2/1974 Hill ..... 340/576 X
4,031,467 6/1977 Singleton, Jr. et al. ..... 455/526
4,058,796 11/1977 Oishi et al. ..... 340/575 X
4,644,330 2/1987 Dowling ..... 340/575
4,965,552 10/1990 Price et al. ..... 340/566

*Primary Examiner*—Thomas Mullen

[57] ABSTRACT

A wake-up device includes at least one sound source for use in a wake-up action. A speaker unit converts electric signals from the at least one sound source into sound signals. A signal processor changes the condition of electric signals from the at least one sound source. A random number generator generates a random number. A controller performs sound source selection in accordance with the random number generated by the random number generator, and/or changes the conditions of electric signals from the at least one sound source by means of the signal processor.

6 Claims, 3 Drawing Sheets

WAKE-UP DEVICE

FIELD OF THE INVENTION

The present invention relates to a wake-up device, in particular to a wake-up device capable of waking a person up whenever he is sleepy.

BACKGROUND OF THE INVENTION

There have been suggested several sorts of wake-up devices, each of which may be provided in a position adjacent to a driver's seat within a motor vehicle, to wake-up a driver whenever the driver gets sleepy so as to ensure safe driving.

Japanese Utility Model Gazette No.4-15536 discloses a wake-up device for use in a motor vehicle. Such a wake-up device, having a vibration unit into which a car stereo reproducing signal may be fed, forms a sensible stereo apparatus using both the vibration unit and the car stereo signal, thereby sending both a vibration and a sound to a driver.

However, in the above-mentioned wake-up device, since there is only one sound source for use to produce an audio signal for waking up a sleepy driver, the same sound is repeated again and again, as a result a driver will get tired of the repeated dull sound. For this reason, a wake-up function is not as effective as is expected.

SUMMARY OF THE INVENTION

It is an object of the present invention to provide an improved wake-up device capable of preventing a person from getting tired of a sound signal, so as to keep a desired wake-up function as effective as possible, thereby solving the above-mentioned problem peculiar to the above-mentioned prior art.

According to the present invention, there is provided a wake-up device comprising: at least one sound source for use in a wake-up action; a speaker unit for converting electric signals from the at least one sound source into sound signals; a signal processor for changing the conditions of electric signals from the at least one sound source; a random number generator for generating a random number; a controller capable of performing sound source selection in accordance with the random number generated by the random number generator, and/or changing the conditions of electric signals from the at least one sound source by means of the signal processor.

According to one aspect of the present invention, said wake-up device includes a plurality of sound sources for use in a wake-up action, said controller is capable of selecting one sound source from the plurality of the sound sources, in accordance with the random number generated by the random number generator. Further, a plurality of signals from the plurality of sound sources are mixed together to be emitted out through the speaker unit.

According to another aspect of the present invention, said wake-up device includes a timer which is adapted to measure a predetermined time interval, in a manner such that as soon as such a time interval is passed, a random number is generated by the random number generator.

According to a further aspect of the present invention, the at least one sound source is a television receiver, a radio receiver, or a recording medium reproducing device capable of reproducing signals recorded on a recording medium. In particular, the recording medium is an optical disc which has optically recorded thereon audio signals, a magnetic tape which has magnetically recorded thereon audio signals, or a solid state memory which has electrically recorded thereon audio signals.

According to a still further aspect of the present invention, the audio signals recorded on the recording medium are at least one of an alerting sound, a bothering sound, an uncomfortable drumming sound, and a soothing or cool-feeling sound.

The above objects and features of the present invention will become more understood from the following description with reference to the accompanying drawings.

DETAILED DESCRIPTION OF THE PREFERRED EMBODIMENTS

Figure 1:
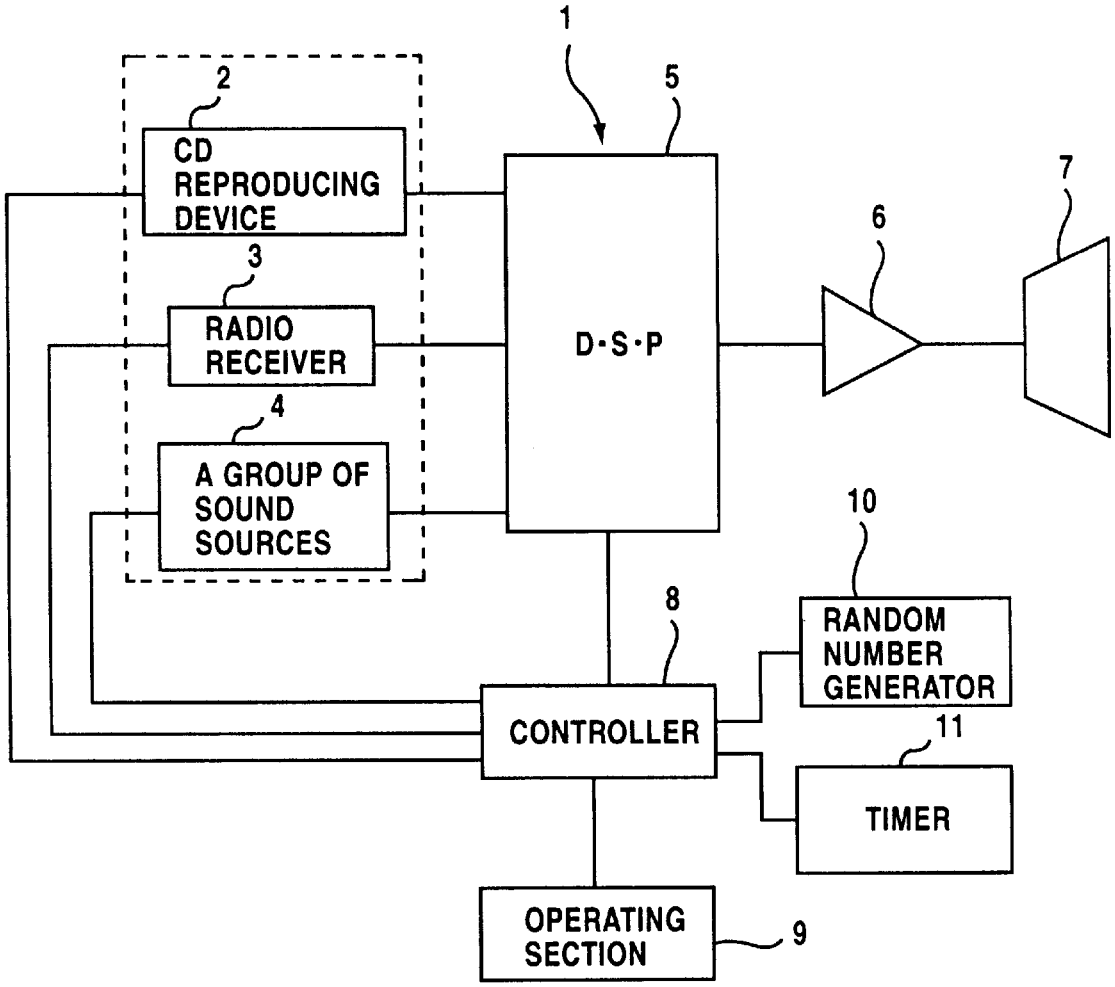
FIG. 1 is a block diagram indicating a wake-up device made according to the present invention.

Referring to FIG. 1, a wake-up device 1 of the present invention includes a CD reproducing device 2, a radio receiver 3, a group of sound sources (units) 4 capable of reproducing a recording medium such as an MD (Mini-disc) or a magnetic tape which has recorded therein an audio signal having a wake-up function.

The CD reproducing device 2, the radio receiver 3 and the sound sources 4 are all connected with a DSP (Digital Signal Processor) 5 which is provided to process the digital signals fed from the units 2–4.

As shown in FIG. 1, electrical signals from the DSP are fed to an amplifier 6 so as to be amplified, and are further fed to a speaker unit 7 to be converted into sound signals.

Further, the wake-up device 1 has a controller 8 which is provided to detect which of the units 2–4 is in operation, and to control the DSP 5 to change the conditions of the electric signals from the units 2–4 in order to obtain an increased wake-up effect.

In addition, the wake-up device 1 involves an operating section 9 including a start key (not shown) and a stop key (not shown), a random number generator 10 and a timer 11. The operating section 9 is used to start or stop the wake-up device 1. The random number generator 10 is provided to enable the controller 8 to select one of the units 2–4 in accordance with a random number generated from the random number generator 10.

In practice, the controller 8 contains a micro-computer, the random number generator 10 is so constructed that it can generate a random number in accordance with a program stored in the micro-computer, the timer 11 is provided to measure the passing of a predetermined time (for example, 40 second). In fact, the timer 11 can also be formed as a clock signal generator contained in the micro-computer.

The sound sources 4 include an MD player, a cassette tape recorder, or even a television receiver.

A recording medium to be reproduced either by the CD reproducing device 2 or by the sound sources 4 (an MD player or a cassette tape recorder) may record one or more additional sounds, such as an alerting sound (a sound of siren), a bothering sound (a sound of friction or breaking), an uncomfortable drumming sound (a sound of deep drumming), and a soothing or cool-feeling sound (a sound of water flowing or raining).

Figure 2A:
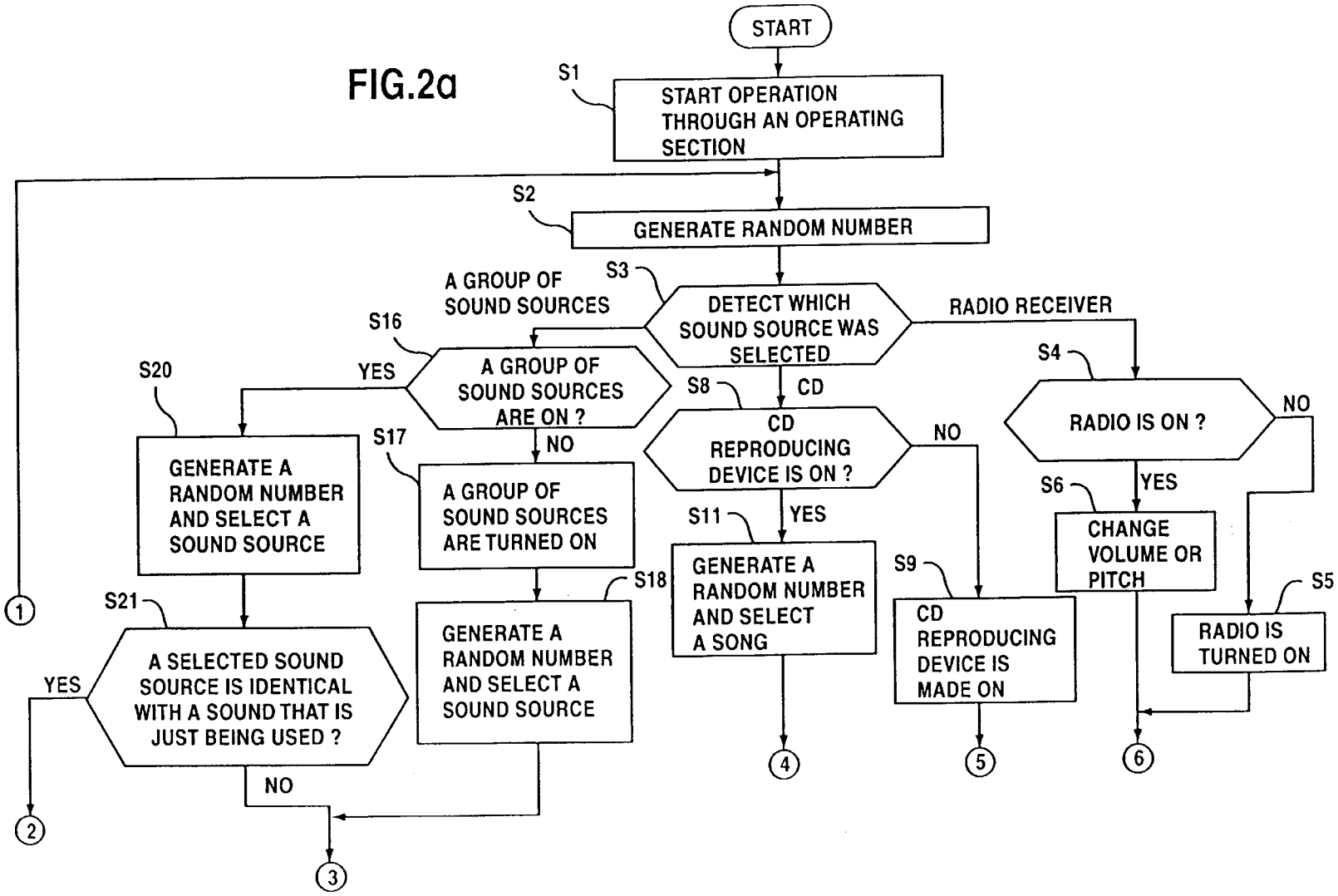
FIG. 2 is a flowchart indicating an operation of the wake-up device made according to the present invention.
Figure 2B:
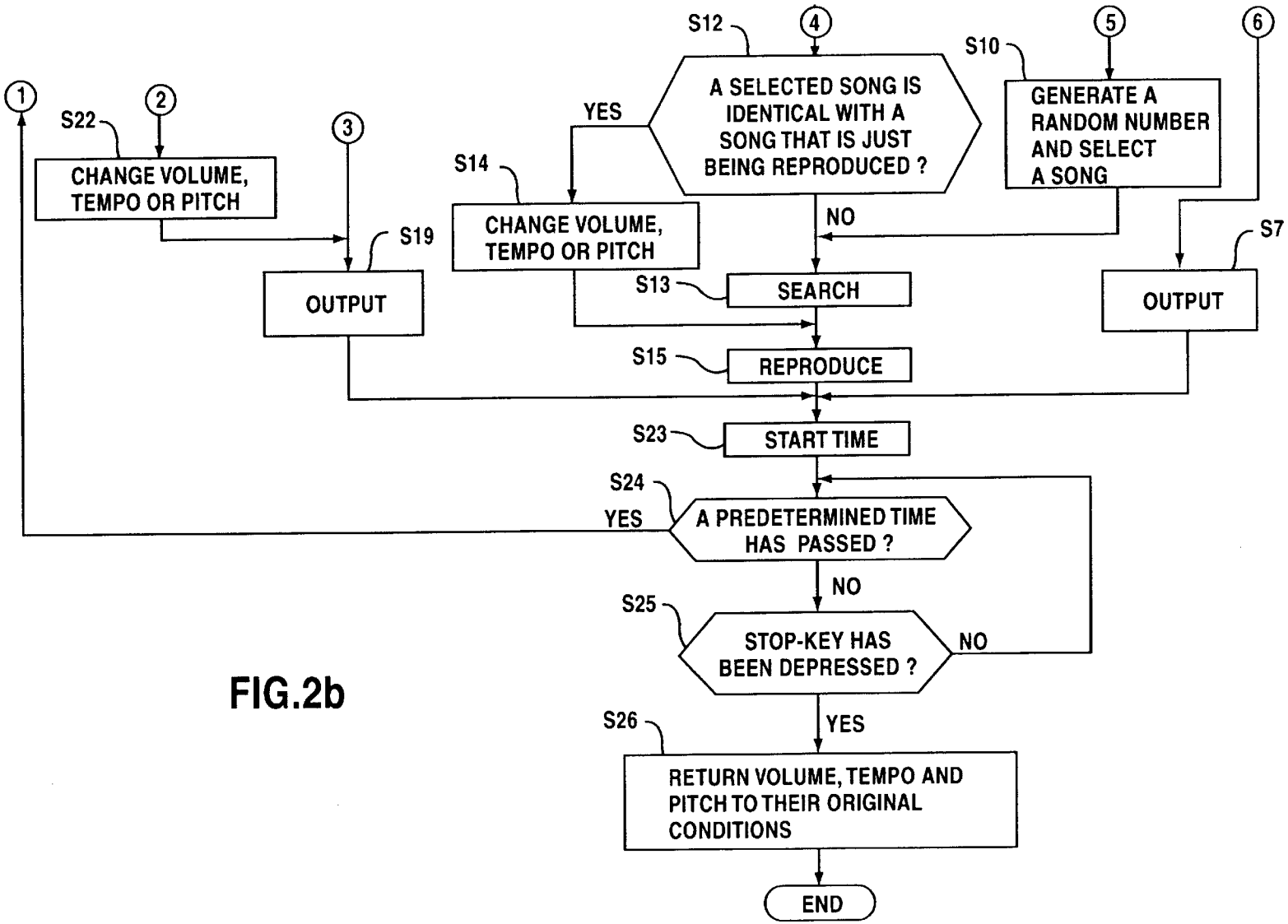

An operation of the wake-up device 1 made according to the present invention may be described with reference to FIGS. 2*a* and 2*b*.

At step S1, the start key of the operating section 9 is operated to render the wake-up device 1 to be in an operable condition. The operation at step S1 actuates the random number generator 10 so that a random number is generated. At this moment, the controller 8 operates to select one of the units 2–4 (all usable as a wake-up sound source) in accordance with the random number. Namely, if the group of sound sources 4 is counted as 1, then there are 3 sound sources in all with the other two being the CD reproducing device 2 and the radio receiver 3. This time, the random number generated by the random number generator 10 is divided by an integral number 3 to produce three possible results: a) exactly dividable without a remainder; b) with a remainder 1; c) with a remainder 2. In this way, which of the units 2–4 is to be selected will depend on which of the above three different results has been produced. Therefore, an appropriate sound source may be selected at step S2 using a conventional method depending upon which of the above three different results is produced.

At step 3, the controller 8 operates to detect which of the sound sources has been selected. If the radio receiver 3 has been selected, the program goes to step S4 at which it is detected whether the radio receiver 3 is ON. At this time, if data representing a selected sound source is stored in the controller 8, the detection of whether a selected sound source is ON will become much easier. In detail, such data may be stored in a RAM (Random Access Memory) contained in the controller 8, or in other conventional memory means.

If it has been detected at step S4 that the radio receiver 3 is not ON, the radio receiver is turned ON at step S5 and the signals from the radio receiver is produced through the speaker 7. In this way, although the radio receiver 3 produces through the speaker 7 nothing but a normally broadcasted daily program, since a sound environment within a motor vehicle is suddenly changed from a condition having a radio OFF to a condition having a radio ON, a sleepy vehicle driver may be completely woken up.

On the other hand, if it is detected at step S4 that the radio receiver 3 is ON, the program goes to step S6 at which the DSP (Digital Signal Processor) 5 operates to process digital signals from the radio receiver 3 so as to effect a sudden change in the volume or pitch of a wake-up sound which is to be obtained later. Then, the program goes to step S7 at which the electric signal is converted into sound signal through the speaker 7 so as to be emitted therefrom. In fact, the radio receiver 3 serves as a wake-up sound source after step S6. Thus, a sleepy driver, upon feeling a sudden change in the volume of a sound from the radio receiver, will be completely woken up, thus obtaining desired wake-up effect.

A sudden change in sound, whether an increase or a decrease in sound volume, has been proved to have a wake-up effect. In general, a sound changing amount is set at 10 dB that is empirically known to have an effect which is two times as large as its true value, offering a sufficient wake-up effect.

Further, a speed at which a sound volume is changed is empirically set at 0.5 second per action. However, if an amount of volume change is small, it is preferred to have a much higher speed. Moreover, the longer the time passed after the start of using the wake-up device 1, the larger the amount of a volume change should be. For example, at a moment immediately after the start of using the wake-up device 1, an amount of volume change (increase or decrease) should be 3±1 dB during 0.1 second. On the other hand, at a moment 5 minutes after the start of using the wake-up device 1, an amount of volume change (increase or decrease) should be 9±3 dB during 0.5 minutes.

Meanwhile, when a tempo of sound is changed, an amount of change should be at least 10%. If the tempo change is less than 10%, it will be difficult for a sleepy driver to feel a sudden change in sound environment. Similarly, the longer the time passes after the start of using the wake-up device 1, the amount of tempo change should increase. For example, at a moment immediately after the start of using the wake-up device 1, an amount of tempo change (increase or decrease) should be 9±3% during 0.1 second. On the other hand, at a moment 5 minutes after the start of using the wake-up device 1, the amount of tempo change (increase or decrease) should be 35±15% during 0.5 second.

Further, when a pitch of the sound is changed, an amount of change should be at least 1 octave. If a pitch change is less than 1 octave, it will be difficult for a sleepy driver to feel a sudden change in the sound environment, Similarly, the longer the time passes after the start of using the wake-up device 1, the amount of pitch change should increase. For example, at a moment immediately after the start of using the wake-up device 1, an amount of pitch change (increase or decrease) should be 1±0.5 octave during 0.1 second. On the other hand, at a moment 5 minutes after the start of using the wake-up device 1, an amount of pitch change (increase or decrease) should be 2.5±1.5 octave during 0.5 second.

Whether there should be an increase or a decrease in volume, tempo, pitch of a sound, will be decided by a random number generated in the random number generator 10. Further, an amount of such an increase or a decrease will also be decided by the generated random number.

Referring to FIG. 2, if at step S3 the CD reproducing device 2 is selected, the program goes to step S8 at which it is detected whether the CD reproducing device is ON or not. If the CD reproducing device is not ON, it is turned ON at step S9. At step S10, one of the songs recorded on a CD mounted in the CD reproducing device 2 is optionally selected in accordance with a random number generated by the random number generator 10. After a song is selected at step S10, the program goes to step 13 at which the selected song is searched out so as to be reproduced at step S15. In this way, since a normal sound environment in which a song is emitted from the speaker 7 in a normal condition (normal volume, tempo and pitch), is suddenly changed into a different sound environment in which a different song is emitted from the speaker 7, or since a sound environment having another sound source is suddenly replaced by a sound environment having a CD reproducing device as as sound source, a vehicle driver will be woken up completely by the sudden change in the sound environment.

On the other hand, if it is determined at step 8 that the CD reproducing device 2 is already ON, the program goes to step S11 at which one of the songs recorded on the CD mounted in the CD reproducing device 2 is optionally selected in accordance with a random number generated by the random number generator 10. At step 12, it is detected whether the selected song is now in the process of production. Such a detection may be easily performed by comparing an inherent data of a track number of the selected song with that of the song now being reproduced, with the use of a comparator circuit contained in the controller 8. If it is determined that the selected song is different from the song now being reproduced, the program goes to step S13 at which the selected song is searched out so as to be reproduced at step S15. On the other hand, if it is determined at step S12 that the selected song is identical with the song now being reproduced, the volume, tempo or pitch of the song is changed through the DSP 5 at step S14 before the program goes to step S15.

In this manner, since a normal sound environment in which a song is emitted from the speaker 7 in a normal condition (normal volume, tempo and pitch), is suddenly changed into a different sound environment in which a song is emitted from the speaker 7 in a different condition (different volume, tempo and pitch), a sleepy driver will be woken up completely by the sudden change in the sound environment In addition, the sudden changing of a song and the sudden changing of the volume, tempo or pitch of a song, may be performed at the same time, thereby obtaining a more remarkable wake-up effect.

Referring again to FIG. 2, if at step S3, a group of sound sources 4 is selected, the program goes to step S16 at which it is detected whether the group of sound sources 4 is turned ON or not. If it is detected that the group of sound sources 4 is turned OFF, the program goes to step S17 at which a mode for using the group of sound sources 4 is selected so as to render the group of sound sources 4 in a usable condition. At step S18, a random number is generated by the random number generator 10, so as to select one sound source from the group of sound sources 4 in accordance with the random number, and to produce the sound at step S19.

On the other hand, if it is detected at step 16 that the group of sound sources 4 is turned ON, the program goes to step 20 at which a random number is generated by the random number generator 10, so as to select one sound source from the group of sound sources 4 in accordance with the random number. Then, at step S21, it is detected whether or not the selected sound source is the one that is currently in use. If it is detected that the selected sound source is different from the one that is currently in use, the program goes to step 19 at which the signal from the selected sound source is output. However, if it is detected that the selected sound source is identical with the one that is currently in use, the program goes to step 22 at which the volume, tempo or pitch of the sound is changed before the signal from the selected sound source is output at step S19.

Whether a radio broadcast is output at step S7, a selected song is reproduced at step S15, or a sound from a He selected sound source is output at step S19, at this moment a timer contained in the controller 8 is started at step S23. Then, an output from step S7, step S15 or step S19 is emitted through the speaker 7 during a time period (for example, 40 seconds) preset by the timer. At step S24, the controller 8 operates to observe whether a preset time period has passed or not. If the preset time period has passed and the stop key of the operating section 9 has not been operated to stop the wake-up device, the program goes back to step S2 to repeat the above same process. On the other hand, if the preset time period has not passed, the program goes to step S25 at which it is observed whether or not the stop key of the operating section 9 has been operated to stop the wake-up device 1. If the stop key has not been operated for stopping the wake-up device 1, the program goes back to step S24. On the other hand, if the stop key has already been operated for stopping the wake-up device 1, at step 26 the volume, tempo and pitch of output signal are returned back to their original conditions as if the wake-up device 1 has not been used. In this way, after the use of the wake-up device 1, the sound environment may be smoothly restored to a normal condition so as to enable a driver to enjoy an agreeable sound environment such as radio broadcast, a music from CD or from other sound sources In the present invention, when one sound source is to be changed over to another sound source, and/or volume, tempo or pitch of a sound is to be changed from one level to another level, it is preferred that such a changeover be completed in a predetermined manner. Namely, the longer the time passed after the start of using the wake-up device 1, the shorter the changeover time should be. For example, at a moment immediately after the start of using the wake-up device 1, a changeover time may be 40±20 seconds. On the other hand, at a moment 5 minutes after the start of using the wake-up device 1, a changeover time should be 10±9 seconds.

Although in the above description it is taught that the volume, tempo or pitch of a sound is changed if a selected sound source is identical with the one that is currently in use, the wake-up device 1 may also be constructed such that the volume, tempo or pitch is changed even if a selected sound source is different from the one that is currently in use.

Further, it is also possible that a special sound such as an alerting sound sent from one sound source of a group of sound sources 4 may be mixed into a program of the radio broadcast sent from the radio receiver 3 or a song being reproduced by a CD reproducing device, so that the mixed sound may be emitted from the speaker 7. In other words, a plurality of sound sources (for example, two sound sources) may be selected in accordance with a random number generated by the random number generator 10, and two signals from different sound sources are mixed together so as to be converted into sound signals and be emitted out through the speaker 7. In such a case, it may be that the longer the time passes after the start of using the wake-up device 1, the amount of a volume (or tempo or pitch) change increases. For example, at a moment immediately after the start of using the wake-up device 1, an amount of volume change (increase or decrease) may be 3±1 dB. On the other hand, at a moment 5 minutes after the start of using the wake-up device 1, an amount of volume change (increase or decrease) should be 9±3 dB.

As is understood from the above description, with the use of the wake-up device made according to the present invention, the sound environment within a motor vehicle may be suddenly changed in many ways, such as suddenly changing one sound source to another sound source, suddenly changing the condition (volume, tempo or pitch) of a sound, suddenly changing one music (song) to another music (song), using some special sounds (including an alerting sound, a bothering sound, an uncomfortable drumming sound, and a soothing or cool feeling sound). Therefore, a sleepy driver will be woken up completely by such a sudden change in the sound environment.

While the presently preferred embodiments of the invention have been shown and described above, it is to be understood that these disclosures are for the purpose of is illustration and that various changes and modifications may be made without departing from the scope of the invention as set forth in the appended claims.

What is claimed is:

1. A wake-up device comprising:

a plurality of sound sources for use in a wake-up action;

a speaker unit for converting electric signals from the sound sources into sound signals;

a signal processor for changing conditions of the electric signals from the sound sources;

a random number generator for generating a random number;

a controller capable of selecting one sound source from the plurality of sound sources in accordance with the random number generated by the random number generator, and/or changing the conditions of electric signals from the sound sources by means of the signal processor.

2. A wake-up device according to claim 1, wherein a plurality of signals from the plurality of sound sources are mixed together to be emitted out through the speaker unit.

3. A wake-up device according to claim 1, wherein said wake-up device includes a timer which is adapted to measure a predetermined time interval, in a manner such that as soon as the predetermined time interval has passed, the random number is generated by the random number generator.

4. A wake-up device according to claim 1, wherein at least one sound source is a television receiver, a radio receiver, or a recording medium reproducing device capable of reproducing signals recorded on a recording medium.

5. A wake-up device according to claim 4, wherein the recording medium is one of an optical disc which has optically recorded thereon audio signals, a magnetic tape which has magnetically recorded thereon audio signals, and a solid state memory which has electrically recorded thereon audio signals.

6. A wake-up device according to claim 5, wherein the audio signals recorded on the recording medium are at least one of an alerting sound, a bothering sound, an uncomfortable drumming sound, and a cool-feeling sound.

* * * * *